US005079783A

United States Patent [19]

Haletsky et al.

[11] Patent Number: 5,079,783

[45] Date of Patent: Jan. 14, 1992

[54] RECHARGEABLE SELF-CONTAINED DEODORIZING TOILET SEAT

[75] Inventors: Chris A. Haletsky, 4415 Inglewood Blvd., Apt. 16, Los Angeles, Calif. 90066; George Sanchez, Northridge, Calif.

[73] Assignee: Chris A. Haletsky, Los Angeles, Calif.

[21] Appl. No.: 682,004

[22] Filed: Apr. 8, 1991

Related U.S. Application Data

[63] Continuation of Ser. No. 597,155, Oct. 12, 1990, abandoned, which is a continuation of Ser. No. 305,614, Feb. 3, 1989, abandoned.

[51] Int. Cl.[5] ..... A47K 13/30; E03D 9/04

[52] U.S. Cl. ..... 4/217; 4/352

[58] Field of Search ..... 4/213, 216, 217, 348-352

[56] References Cited

U.S. PATENT DOCUMENTS

| | | | |
|---|---|---|---|
| 1,549,871 | 8/1925 | Hatch | 4/217 |
| 2,112,772 | 3/1938 | Greene | 4/213 |
| 2,389,165 | 11/1945 | Riedele | 4/217 |
| 2,519,286 | 8/1950 | Riedele | 4/217 |
| 2,724,840 | 11/1955 | Scott et al. | 4/213 X |
| 2,747,201 | 5/1955 | Herriott | 4/213 |
| 2,849,727 | 9/1958 | Bollinger et al. | 4/348 X |
| 3,108,289 | 10/1963 | Smith | 4/213 |
| 3,333,285 | 8/1967 | Null | 4/217 |
| 3,357,029 | 12/1967 | Schulz | 4/217 |
| 3,386,109 | 6/1968 | Christian et al. | 4/213 |
| 3,491,382 | 1/1970 | Poister | 4/217 |
| 3,501,784 | 3/1970 | Maisch | 4/217 |
| 3,659,296 | 5/1972 | Stamper | 4/217 |
| 3,733,619 | 5/1973 | Smith | 4/72 |
| 3,740,772 | 7/1973 | Paley | 4/217 |
| 3,790,702 | 2/1974 | Bendersky et al. | 4/217 |
| 3,896,509 | 7/1975 | Stipp et al. | 4/209 |
| 13,913,150 | 10/1975 | Poister | 4/213 |
| 3,953,901 | 5/1976 | Poister et al. | 4/213 |
| 4,174,545 | 11/1979 | Smith, Jr. | 4/217 |
| 4,251,888 | 2/1981 | Turner | 4/213 |
| 4,301,555 | 11/1981 | Poister | 4/217 |
| 4,556,999 | 12/1985 | Lindley | 4/217 |
| 4,586,201 | 5/1986 | Todd | 4/217 |
| 4,617,687 | 10/1986 | Wadsworth | 4/213 |

FOREIGN PATENT DOCUMENTS

| | | | |
|---|---|---|---|
| 1291075 | 3/1969 | Fed. Rep. of Germany | 4/213 |

*Primary Examiner*—Charles E. Phillips
*Attorney, Agent, or Firm*—Cohen: Lawrence C.; Timothy T. Tyson

[57] ABSTRACT

A rechargeable self-contained deodorizing toilet seat is provided for installation on any standard toilet to remove bathroom odors. The seat is substantially the same in size and appearance as a standard toilet seat. Air conduits pass though the right and left sides of the seat member from the lower surface to the outer surface. The conduits contain activated carbon air filtration media and blowers for moving the air. Seals on the lower surface seal the seat to the toilet rim except at the front where ducts are provided for the introduction of fresh air. Lips on the inner edges of the ducts deflect air down into the bowl. The blowers are rotated by direct current electric motors powered by rechargeable batteries. Operation of the motors is controlled by switches which close only when the lid is raised and weight is placed on the seat. An electronic timer turns off the air filtration system after a preset period of time to conserve the battery power.

14 Claims, 3 Drawing Sheets

FIG. 1
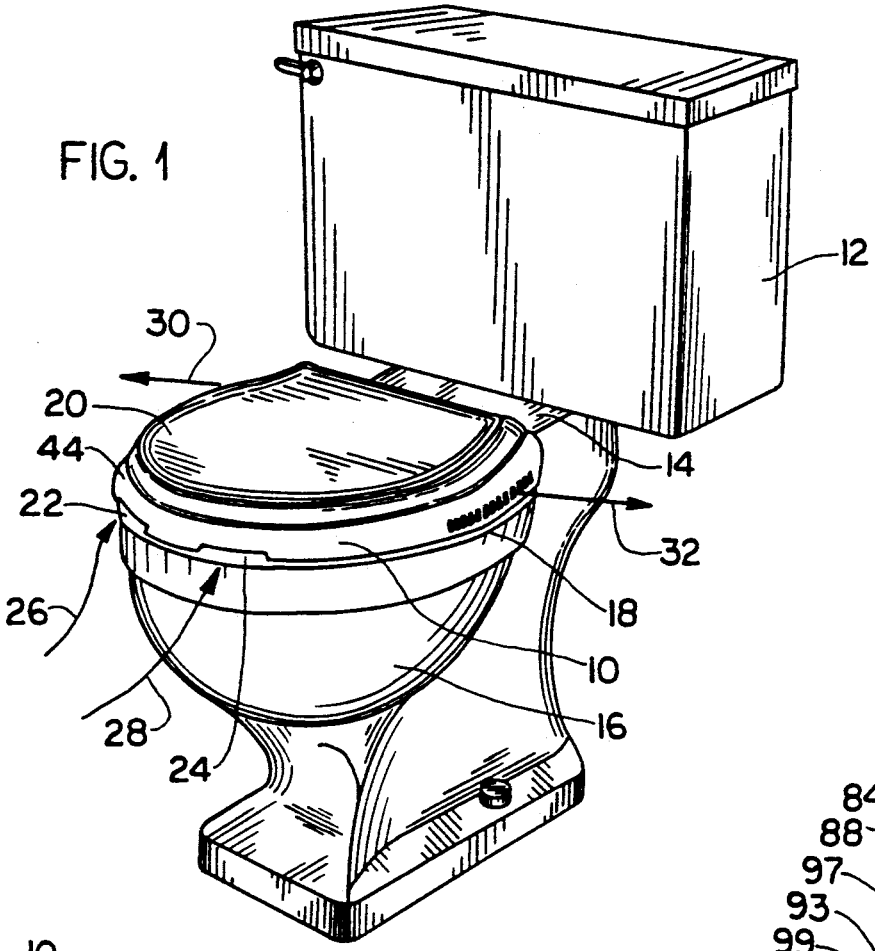
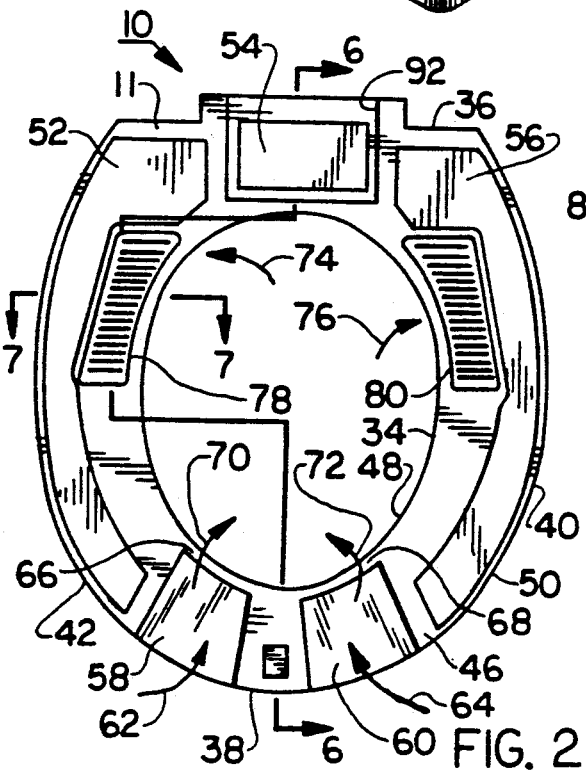
FIG. 2
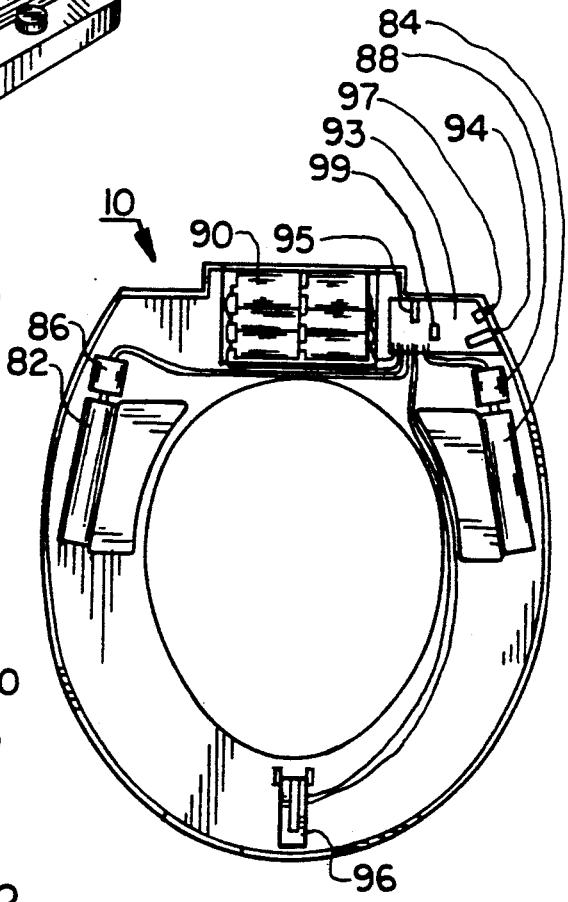
FIG. 3

RECHARGEABLE SELF-CONTAINED DEODORIZING TOILET SEAT

This is a continuation of a prior application Ser. No. 07/597,155, filed Oct. 12, 1990 which is a continuation of a prior application Ser. No. 07/305,614, filed Feb. 3, 1989 both now abandoned.

TECHNICAL FIELD

The present invention pertains to the restroom ventilation art, and more particularly, to a toilet seat having deodorizing air filtration media therein and electrical blowers for drawing air therethrough.

BACKGROUND ART

Odors created in restrooms have long been aleviated by electrically powered ventilation equipment. Generally the ambient air has been exhausted to the outside through air ducts. Numerous specialized ventilation devices have been developed utilizing external exhausting and having inlets directed to the area around the toilet bowel by or through the toilet seat such as those shown in U.S. Pat. Nos. 2,112,772; 2,389,165; 2,519,286; 3,108,289; 3,357,029; 3,733,619; 3,896,509; 4,251,888; 4,556,999; and 4,617,687. All of these devices require the construction of cumbersome and expensive ducting through the walls of the restroom to the toilet. Several ventilation devices with similar inlets have been developed utilizing the attributes of activated carbon or other filtration media to return the deodorized air to the restroom thereby eliminating the need for external ducting such as those shown in U.S. Pat. Nos. 2,747,201; 3,386,109; 3,491,382; 3,790,970; and 4,174,545. However, all of these require unsightly boxes positioned behind the toilet bowl and under the water tank as well as flexible connections to the toilet seat or toilet seat area which allow the seat to be raised. Two similar devices shown in U.S. Pat. Nos. 3,913,150 and 3,953,901 have the filtration media and blowers hidden inside the toilet tank area with the result that retrofitting to existing installations is not possible. One device shown in U.S. Pat. No. 3,501,784 has all of the necessary equipment situated in an expansion of the rear of the toilet seat between the two attaching bolts thereby allowing the ventilator seat to be substituted for existing seats. Even so, the device does not look like an ordinary toilet seat and requires the area of the rear of the seat for equipment thereby eliminating this portion for seating purposes. An easily installed toilet seat having odor removal capabilities without encumbering the toilet seat area either visually or physically would offer significant advantages over the prior art toilet ventilation devices.

DISCLOSURE OF INVENTION

The present invention is directed to a deodorizing toilet seat which will fit onto most existing toilets in place of the regular toilet seat. The seat has a seat member with the standard elliptical shape creating an elliptical opening therethrough matching substantially the rim of the toilet bowl. At least one air conduit passes through the seat member in the left or right portions and has an inlet at the inner or lower surface and an outlet at the outer or lower surface. An air seal member mounted on the lower surface between the inlet and outlet contacts the rim of the toilet bowl to keep air from readily passing from the outlet back to the inlet. An air mover means in the conduit moves air from the inlet to the outlet through deodorizing air filtration media. In a preferred embodiment, air conduits are provided through both the left and right portions.

In accordance with one important aspect of the invention, the inlet is on the lower surface and the air filtration media is packaged in a disposable cartridge. The cartidge is positioned in the inlet allowing an unused cartridge to be readily exchanged for a used cartridge. In a preferred embodiment, the cartridge has liquid deflecting louvers on the inlet grill.

In accordance with another important aspect of the invention, the air mover means includes a blower wheel having an axis perpendicular to the air conduit. The wheel is coupled to a direct current electric motor powered by a battery through a switch which is only closed when a person sits on the seat. In a preferred embodiment, the battery is rechargeable through a coupling on the outer surface and has an electronic timer switch which turns off the motor after a predetermined time in order to conserve the battery.

In accordance with another important aspect of the invention, the air seal member contacts the rim of the toilet bowl below the left, right, and rear portions leaving the front open for the entry of ambient air into the toilet bowl. In a preferred embodiment, the lower surface of the front portion has indentations for providing more space for the introduction of fresh air into the toilet bowl. An inner lip at the intersection of the lower and inner surfaces of the front portion deflects fresh ambient air passing through the indentation from the rim down into the toilet bowl bottom displacing the contaminated air forcing it to rise to the inlets of the air conduits. Fresh air from the indentations is thereby unable to short circuit its passage down into the toilet bowl by going directly to the air conduits.

BRIEF DESCRIPTION OF DRAWINGS

FIG. 1 is a front and right side perspective view of the rechargeable self-contained deodorizing toilet seat in accordance with the present invention installed on a standard toilet;

FIG. 2 is an enlarged bottom plan view of the seat;

FIG. 3 is a bottom plan view of the seat with the bottom member removed revealing the interior;

MODES FOR CARRYING OUT THE INVENTION

Figure 4:
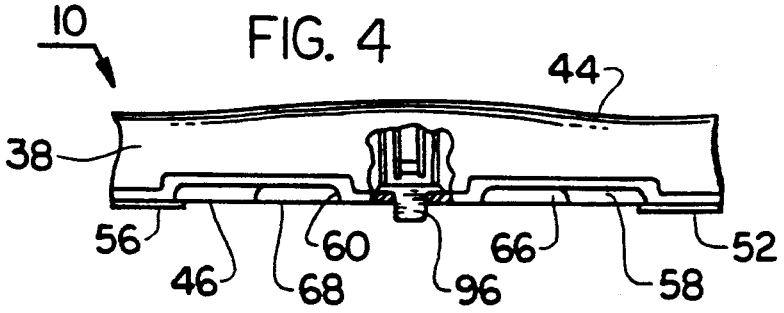
FIG. 4 is an enlarged partial front elevational view of the seat with a cutaway sectional view of the switch.

Referring to FIG. 1, there is illustrated a front and right side perspective view of the rechargeable self-contained deodorizing toilet seat, generally designated 10, in accordance with the present invention installed on a standard toilet 12. No changes are required to the toilet nor does the deodorizing toilet seat look significantly different from a standard toilet seat. The deodorizing toilet seat 10 is installed by removing the old seat, inserting the two attachment bolts of the seat into two holes near the rear 14 of the toilet bowl 16, and lowering the seat to the rim 18 of the bowl. A lid 20 is provided similar to lids on standard toilet seats. The deodorizing toilet seat 10 serves both as a regular toilet seat and as an odor removal system. When the center opening is closed, an air filtration system inside the seat 10 draws fresh ambient air into the toilet bowl 16 over the rim 18 through inlet ducts 22 and 24 as represented by the arrows 26 and 28. Contaminated air inside the bowl is drawn into air conduits in the seat through air filtration media where the odors are removed. The cleaned air is expelled through outlets on either side as represented by the arrows 30 and 32.

FIG. 2 is an enlarged bottom plan view of the seat 10. The seat member 11 has an elliptical shape and a resulting elliptical first opening 34 which substantially matches the shape of the rim of the toilet bowl. For purposes of description, the seat member is divided into rear, front, left, and right portions 36, 38, 40, and 42, respectively, and upper, lower, inner, and outer surfaces 44 (FIG. 1), 46, 48, and 50, respectively. Air seal members 52, 54, and 56 are mounted on the lower surface 46 for sealing the seat 10 to the rim of the toilet bowl. Relatively no air is able to enter the bowl under the side and back portions. Only the front portion is left unsealed. Ducts 24 and 26 (FIG. 1) created by indentations 58 and 60 in the lower surface 46 of the front portion operating with the rim increase the space for fresh air represented by the arrows 62 and 64 to flow into the bowl. Inner lips 66 and 68 at the intersection of the lower and inner surfaces 46 and 48 deflect the air down into the toilet bowl as represented by the arrows 70 and 72. Contaminated air represented by the arrows 74 and 76 exits the bowl through grills 78 and 80 at the inlets to the air filtering system.

FIG. 3 is a bottom plan view of the seat 10 with the bottom member removed revealing the interior. Air mover means in the form of blower wheels 82 and 84 are positioned adjacent the grills shown in FIG. 2. Direct current electric motors 86 and 88 are coupled to the blower wheels for rotating the wheels. Power for the motors is provided by a pack of rechargeable batteries 90 which is accessable through an exterior battery door 92 (FIG. 2). The batteries may be recharged by an outside electrical source without removing them from the seat through a connector 94 on the outer surface 50 of the seat. Connection between the batteries and the motors is controlled by a power control board 93 which includes four series switches: a normally open main push switch 96 closes only when a person sits on the seat pressing the switch against the rim of the toilet bowl, a normally closed lid sensor switch 95 opens when the lid is down allowing use of the toilet as a seat, an electronic timer switch 99 which turns off the system after a set period of time such as four minutes in order to conserve the batteries, and an on - off switch 97 for either turning off the system entirely or resetting the timer to start a new period.

FIG. 4 is an enlarged partial front elevational view of the seat 10 with a cutaway sectional view of the push switch 96. The air seal members 52 and 56 are fabricated of a spongy material which together with a spring in the switch opens the switch when no weight is on the top surface 44 of the seat. Also shown in FIG. 4 are views of the indentations 58 and 60 in the lower surface 46 of the front portion 38 and the inner lips 66 and 68 for directing fresh air down into the toilet bowl.

Figure 5:
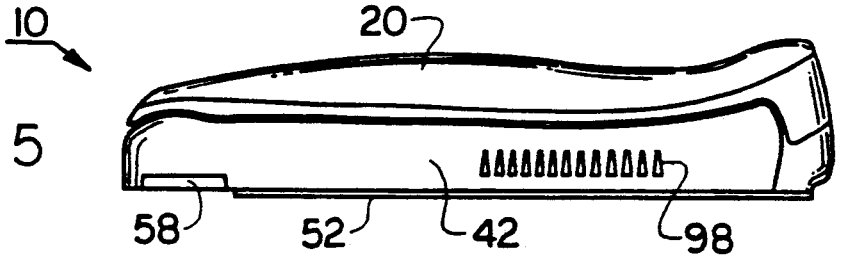
FIG. 5 is a right side elevational view with a lid closed on top.

FIG. 5 is a right side elevational view of the seat 10 with the lid 20 closed on top. The left side elevational view is a mirror image. The air seal member 52 extends under all of the right portion 42 of the seat leaving open only the front where the indent 58 facilitiates the passage of outside air under the seat. Deodorized air is exhausted from the seat through grills 98 and similar grills on the left side.

Figure 6:
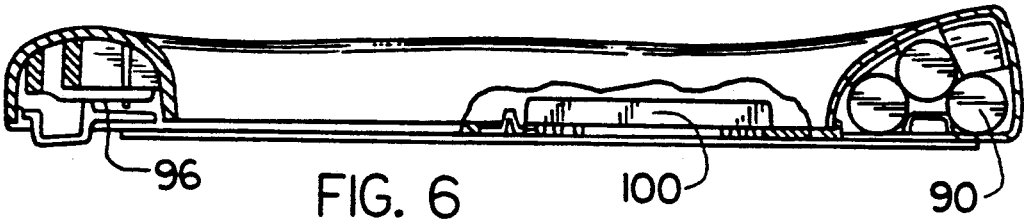
FIG. 6 is an enlarged sectional view along the line 6—6 of FIG. 2.

FIG. 6 is an enlarged sectional view along the line 6—6 of FIG. 2 showing the push switch 96, battery pack 90, and a deodorizing air filtration media 100 mounted in the inlet to the air filtering system.

Figure 7:
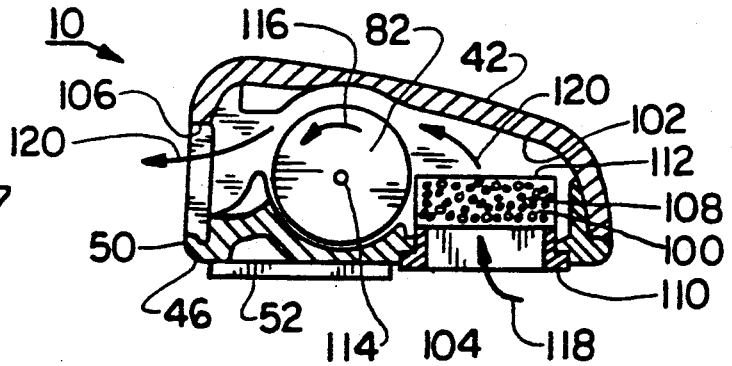
FIG. 7 is an enlarged sectional view along the line 7—7 of FIG. 2.

Operation of the air filtering system is best shown in FIG. 7 which is an enlarged sectional view along the line 7—7 of FIG. 2. An air conduit 102 passes through the right portion 42 of the seat member 10 beginning with an inlet 104 at the lower surface 46 and an outlet 106 at the outer surface 50. Interposed in the airstream are the deodorizing air filtration media 100 and the blower wheel 82. The air filtration media is preferrably fabricated of activated carbon 108 in a disposable package 110 which includes the molded in plastic grill 78 (FIG. 2) which conveniently snaps into the inlet 104. A pleasant refreshing scent may be placed on the downstream side 112 of the media. The blower wheel is mounted in the air conduit 102 with its axis 114 perpendicular to the conduit. When the wheel 82 is rotated in the direction of the arrow 116, contaminated air is drawn into the air conduit 102 as represented by the arrow 118 where it initially passes through the activated carbon and the odors are removed. The cleaned air passes out of the carbon, around the blower wheel, and out of the seat as represented by the arrows 120. The air seal member 52 is mounted on the lower surface 46 between the inlet 104 and outlet 106 for sealing the seat to the rim (FIG. 1) to prevent clean air from returning immediately to the inlet without passing into the toilet bowl. A sectional view of the left air conduit through the left portion (FIG. 2) contains the same elements and would be the mirror image of FIG. 7.

Figure 8:
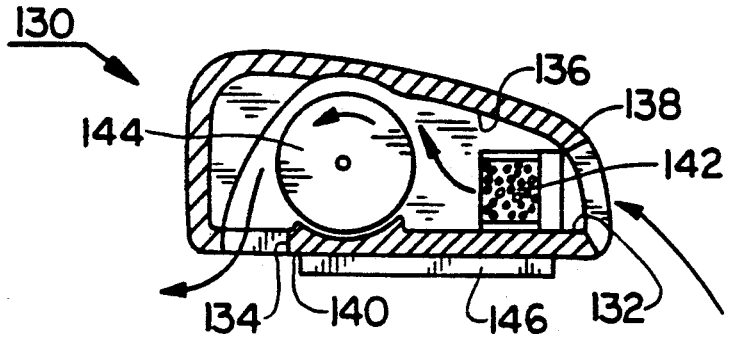
FIG. 8 is an alternative embodiment.

FIG. 8 is an alternative embodiment, generally designated 130, of the present invention similar to FIG. 7 and identical in all respects to the prior embodiment except for the location of the inlet 132 and outlet 134 of the air conduit 136. In this embodiment, the inlet is located on the inner surface 138 and the outlet is located on the lower surface 140. The air filtration media 142 is modified in size to match the new location but its function remains the same as does that of the blower wheel 144. The air seal member 146 mounted on the lower surface 140 also functions in the same manner serving to stop the clean air from flowing immediately back to the inlet.

Figure 9:
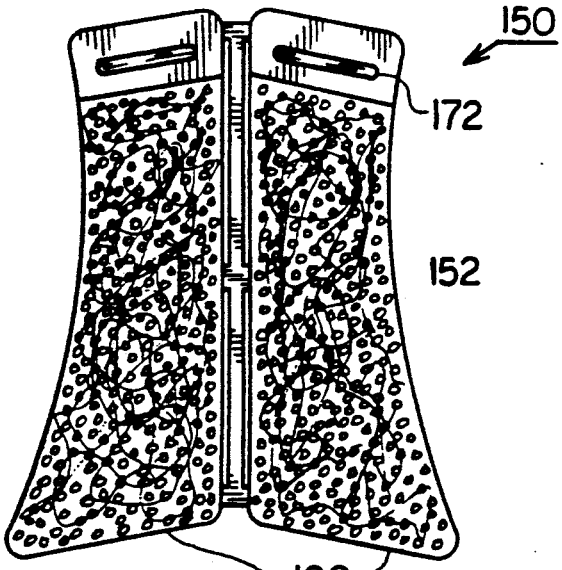
FIG. 9 is an enlarged top plan view of an air filtration media set.
Figure 10:
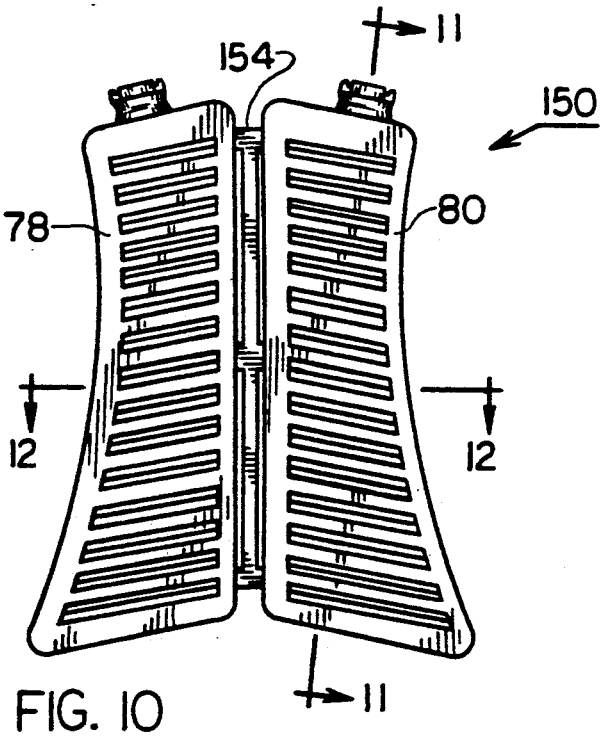
FIG. 10 is a bottom plan view.

FIG. 9 is an enlarged top plan view of an set 150 of two air filtration media 100. A particulate air filtration media 152 is positioned on the downstream side. FIG. 10 is a bottom plan view of air filtration media set 150 showing the upstream inlet grills 78 and 80. The set 150 includes the media for both the left and right air conduits. The set is broken apart along the sprue 154 prior to insertion into the seat 10 as shown in FIG. 2. Construction as a set lowers cost and forces the customer to remove protective wraps prior to use.

Figure 11:
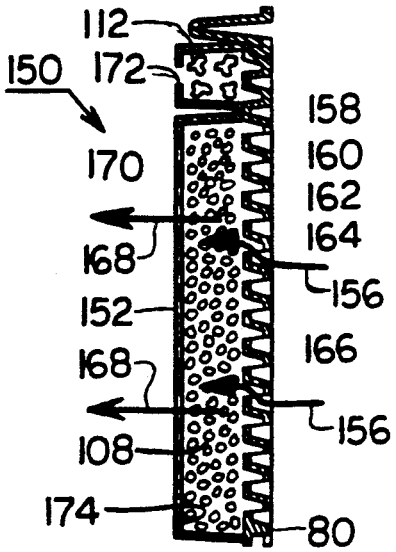
FIG. 11 is a sectional view along the line 11—11 of FIG. 10.
Figure 12:
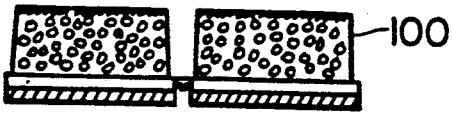
FIG. 12 is a sectional view along the line 12—12 of FIG. 10.

FIG. 11 is a sectional view along line 11—11 of FIG. 10 showing the interior of the air filtration media 100. The grill 80 allows contaminated air to enter as indicated by arrows 156. Of particular importance to the present invention is the construction of the grill to deflect liquid approaching the grill from any angle above an angle substantially perpendicular to the plane of the face 158 when the grill is in a substantially vertical position such as represented in FIG. 11. Without this feature, the air filtration media could readily become contaminated by the liquid. Deflection is achieved by making each louver 160 with three faces: a perpendicular rear portion 162, a downward slanting middle portion 164, and a perpendicular front portion 166 below the middle portion. Liquid hitting any of these portions is deflected downward and eventually flows down off the face 158. On the other hand, air readily enters the grill 80 by passing through the center of the grill parallel to the face 158. Once inside the grill, odors are removed from the air by the activated carbon 108 and clean air exits through the particulate media 152 as represented by the arrows 168. If desired, a pleasant refreshing scent 112 may be placed in an upper compartment 170. This compartment is closed on the grill 80 side but has a slot type of opening 172 on the downstream side. Enough scent is released thereby to freshen the air without any contamination of the activated carbon 108 in the lower compartment 174. FIG. 12 is a sectional view of the media 100 along the line 12—12 of FIG. 10.

In view of the above, it may be seen that a rechargeable deodorizing toilet seat are provided. Of course, the structure may be variously implemented depending upon specific applications. Accordingly, the scope hereof shall not be referenced to the disclosed embodiments, but on the contrary, shall be determined in accordance with the claims as set forth below.

We claim:

1. A deodorizing toilet seat attachable to a toilet above the rim of the toilet bowl, comprising:

a seat member having a first opening therethrough, said seat member having:

a rear portion behind said first opening, a front portion in front of said first opening, a left portion between said rear and front portions on the left side of said seat member, and a right portion between said rear front portions on the right side of said seat member;

upper, lower, inner, and outer surfaces; and at least one air exhaust conduit through said seat member in at least one of said left and right portions having an inlet at said lower surface and an outlet at one of said outer and lower surfaces;

an air inlet proximate the front portion;

air seal means mounted on said lower surface between said inlet and outlet for contacting the rim of the toilet bowl and effectively sealing between the lower surface of the seat and the rim such that substantial air flow may occur through the air inlet;

an air mover means mounted in said at least one air exhaust conduit for selectively moving air from said inlet to said outlet; and deodorizing air filtration media mounted in said at least one air exhaust conduit for deodorizing the air passing therethrough.

2. A toilet seat in accordance with claim 1 wherein said air filtration media is packaged in a disposable cartridge, said inlet is at said lower surface, and said cartridge is positioned in said inlet whereby an unused cartridge is readily exchanged for a used cartridge.

3. A toilet seat in accordance with claim 2 wherein said cartridge includes a grill with a liquid deflecting means whereby liquid is deflected from entering said cartridge when said seat is raised vertically.

4. A toilet seat in accordance with claim 1 wherein said air mover means includes a blower wheel having an axis substantially perpendicular to said air conduit.

5. A toilet seat in accordance with claim 4 and further including a direct current electric motor coupled to said blower wheel for rotating said wheel and at least one battery selectively electrically connected to said motor for providing direct current to said motor.

6. A toilet seat in accordance with claim 5 wherein said at least one battery is rechargeable and further including a connector on said outer surface electrically coupled to said battery whereby said battery can be recharged by an outside electrical source.

7. A toilet seat in accordance with claim 5 and further including at least one electrical switch between said motor and said battery whereby said battery is only connected to said motor when a person sits on said seat.

8. A toilet seat in accordance with claim 7 wherein said at least one switch includes a timer switch turning off said motor after a preselected period of time.

9. A toilet seat in accordance with claim 8 wherein said at least one switch further includes a normally closed switch which opens when a lid on said seat is closed.

10. A toilet seat in accordance with claim 1 wherein said at least one air conduit is a left air conduit through said left portion and a right air conduit through said right portion.

11. A toilet seat in accordance with claim 1 wherein said air seal member contacts the rim of the toilet bowl below the left, right, and rear portions whereby ambient air flows between said front portion and said rim into said toilet bowl.

12. A toilet seat in accordance with claim 11 wherein said lower surface of said front portion further includes at least one indentation increasing the space between said lower surface and said rim.

13. A toilet seat in accordance with claim 12 wherein said at least one indentation has an inner lip at the intersection of the lower and inner surfaces whereby ambient air passing through said indentation is deflected down into the toilet bowl.

14. A deodorizing toilet seat attachable to a toilet above the rim of the toilet bowl, comprising:

a seat member having a first opening therethrough, said seat member having:

a rear portion behind said first opening, a front portion in front of said first opening, a left portion between said rear and front portions on the left side of said seat member, and a right portion between said rear and front portions on the right side of said seat member;

upper, lower, inner, and outer surfaces;

a left air exhaust conduit through said left portion and a right air exhaust conduit through said right portion, each conduit having an inlet at said lower surface and an outlet at said outer surface; and an air inlet defined by at least one indentation in said lower surface of said front portion having an inner lip proximate the intersection of said lower and inner surfaces for deflecting air passing through said at least one indentation down into the toilet bowl;

air seal means mounted on said lower surface between said air exhaust conduit inlets and outlets for contacting the rim of the toilet bowl and effectively sealing between the lower surface of the seat and the rim such that substantial air flow may occur through the air inlet;

air mover means mounted in each of said air exhaust conduits for selectively moving air from said air exhaust conduit inlets to said outlets, each of said air mover means having a blower wheel with an axis substantially perpendicular to said air conduits;

direct current electric motors coupled to each of said blower wheels for rotating said blower wheels and at least one battery selectively electrically connected to said motors for providing direct current to said motors;

an electrical switch between said motors and said battery selectively connecting said battery to said motors only when weight is placed on said seat; and disposable deodorizing air filtration media releasably mounted in each of said air exhaust conduit inlets for deodorizing the air passing therethrough.

* * * * *